US012728320B2

(12) United States Patent
Pittson

(10) Patent No.: US 12,728,320 B2
(45) Date of Patent: Sep. 8, 2026

(54) EXTENDED BALL RETRIEVING DEVICE AND METHOD

(71) Applicant: Edward C. Pittson, Vallejo, CA (US)

(72) Inventor: Edward C. Pittson, Vallejo, CA (US)

( * ) Notice: Subject to any disclaimer, the term of this patent is extended or adjusted under 35 U.S.C. 154(b) by 1050 days.

(21) Appl. No.: 17/895,610

(22) Filed: Aug. 25, 2022

(65) Prior Publication Data

US 2024/0066360 A1 Feb. 29, 2024

(51) Int. Cl.
*A63B 47/02* (2006.01)

(52) U.S. Cl.
CPC ..... *A63B 47/02* (2013.01); *A63B 2243/00* (2013.01)

(58) Field of Classification Search
CPC ..... A63B 47/02; A63B 2243/00; A63B 2243/0062
See application file for complete search history.

(56) References Cited

U.S. PATENT DOCUMENTS

| | | | | |
|---|---|---|---|---|
| 3,029,097 | A | 4/1962 | Ward | |
| 3,982,781 | A * | 9/1976 | Tucker | A63B 47/02 294/19.2 |
| 4,136,901 | A | 1/1979 | Walter | |
| 4,184,707 | A * | 1/1980 | Nelson | A63B 47/02 294/19.2 |
| 4,193,625 | A * | 3/1980 | Nelson | A63B 47/02 294/19.2 |
| 4,580,784 | A | 4/1986 | Brill | |
| 4,596,413 | A * | 6/1986 | La Porte | E01H 1/12 294/99.1 |
| 5,951,075 | A * | 9/1999 | Green | A63B 47/02 206/315.9 |
| D668,306 | S | 10/2012 | Urioste | |
| D727,447 | S | 4/2015 | Sangimino | |
| 10,286,261 | B1 * | 5/2019 | Urioste | A63B 67/066 |
| D857,815 | S | 8/2019 | Wilson, Jr. | |
| 2003/0092498 | A1 * | 5/2003 | Jaramillo, Jr. | A63B 47/002 473/285 |
| 2021/0178236 | A1 * | 6/2021 | Weldon | A63B 63/007 |

FOREIGN PATENT DOCUMENTS

| | | | | |
|---|---|---|---|---|
| WO | WO-9600600 A1 * | 1/1996 | | A63B 47/02 |

* cited by examiner

*Primary Examiner* — Thomas E Lazo

(57) ABSTRACT

An extended ball retrieving device and method for retrieving a bocce ball includes a base being a rectangular prism shape. The base has top surface, a bottom surface, and a pair of side surfaces. A shaft protrudes out from the top surface of the base and has a far end and a near end relative to the base thus the far end of the shaft has a handle. A pair of cradles is positioned on a respective one of the pair of the side surfaces of the base. Each of the cradles further includes a pair of screws being drilled into the base. Each of the screws has an end protruding out from the base and a spring is positioned at the end of each of the screws. A trap is enclosed between the spring and the base and defines a space for a ball to be inserted through.

16 Claims, 10 Drawing Sheets

EXTENDED BALL RETRIEVING DEVICE AND METHOD

CROSS-REFERENCE TO RELATED APPLICATIONS

Not Applicable

(b) STATEMENT REGARDING FEDERALLY SPONSORED RESEARCH OR DEVELOPMENT

Not Applicable

(c) THE NAMES OF THE PARTIES TO A JOINT RESEARCH AGREEMENT

Not Applicable

(d) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(e) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to ball catching device and more particularly pertains to a new ball catching device for retrieving a bocce ball.

(2) Description of Related Art Including Information Disclosed Under 37 CFR 1.97 and 1.98

The prior art relates to ball catching devices. The prior art includes a variety of ball catching devices comprising a shaft configured for reducing the user needing to bend over to retrieve the ball. Known prior art lacks a ball catching device configured for retrieving a bocce ball by inserting the bocce ball through a trap comprising a spring by simply pushing down on the bocce ball.

(h) BRIEF SUMMARY OF THE INVENTION

An embodiment of the disclosure meets the needs presented above by generally comprising a base being a rectangular prism shape. The base has top surface, a bottom surface, and a pair of side surfaces. A shaft protrudes out from the top surface of the base and has a distal end and a proximal end relative to the base wherein the distal end of the shaft has a handle. A pair of cradles is positioned on a respective one of the pair of the side surfaces of the base. Each of the cradles further comprises a pair of screws being drilled into the base. Each of the screws has an end protruding out from the base and a spring is positioned at the end of each of the screws. A trap is enclosed between the spring and the base and defines a space for a ball to be inserted through.

Another embodiment of the disclosure includes a method comprising a step of grabbing a handle of a shaft of a base and positioning a bottom of a first cradle of a pair of cradles over a bocce ball. The user pushes downward on the handle wherein inserting the bocce ball through a trap of the first cradle and catching the bocce ball within a top of the first cradle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
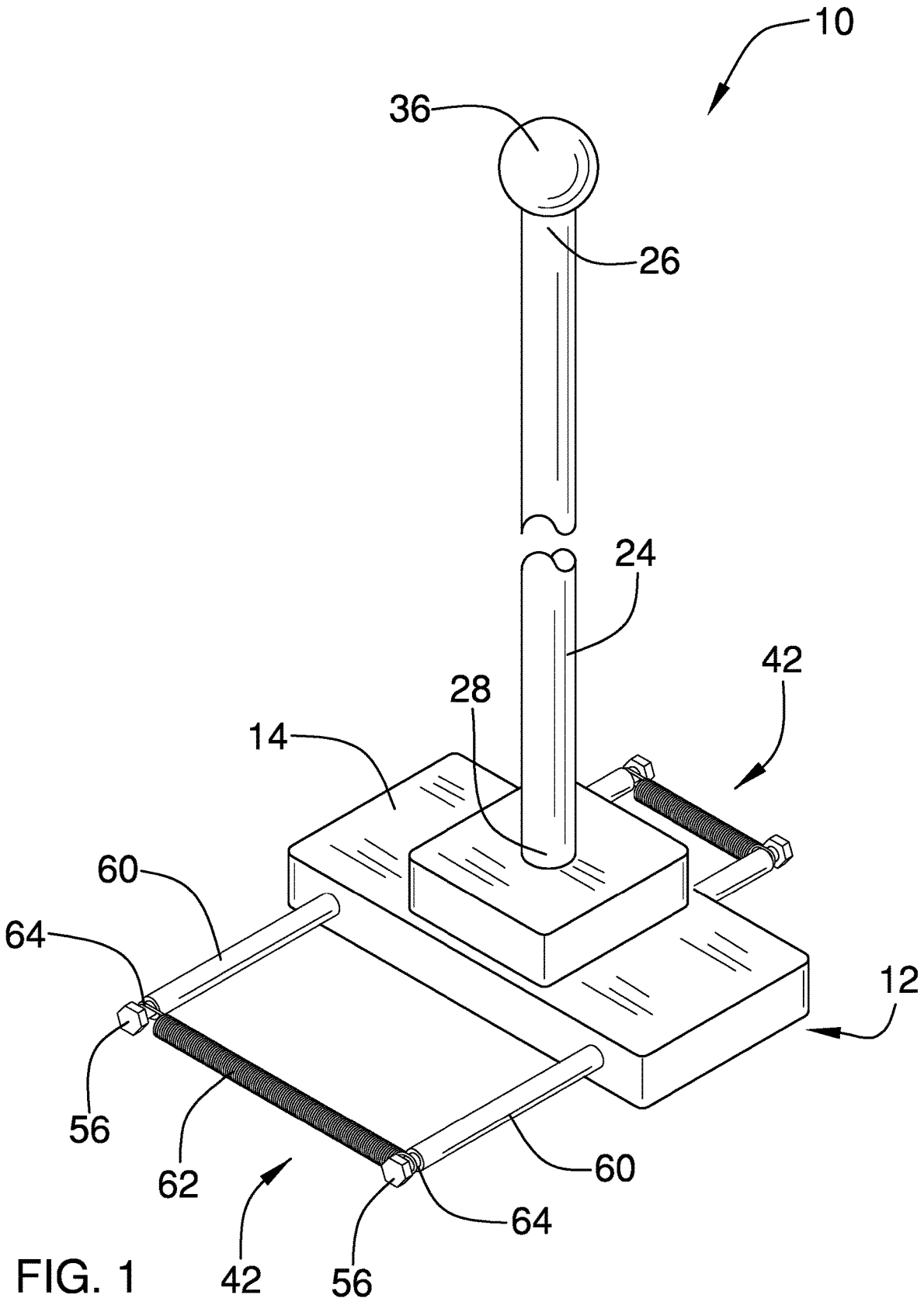
FIG. 1 is a front isometric view of an extended ball retrieving device and method according to an embodiment of the disclosure.
Figure 2:
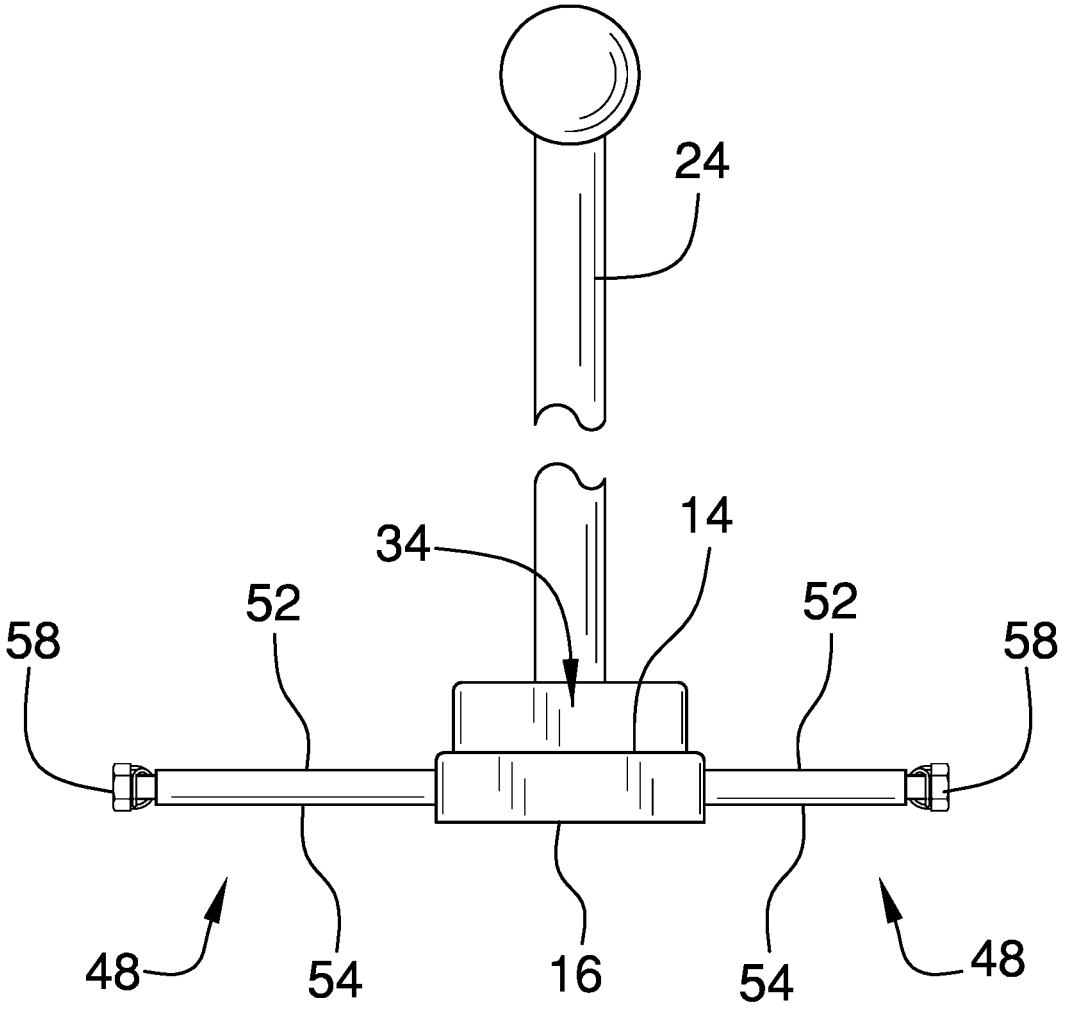
FIG. 2 is a side view of an embodiment of the disclosure.
Figure 3:
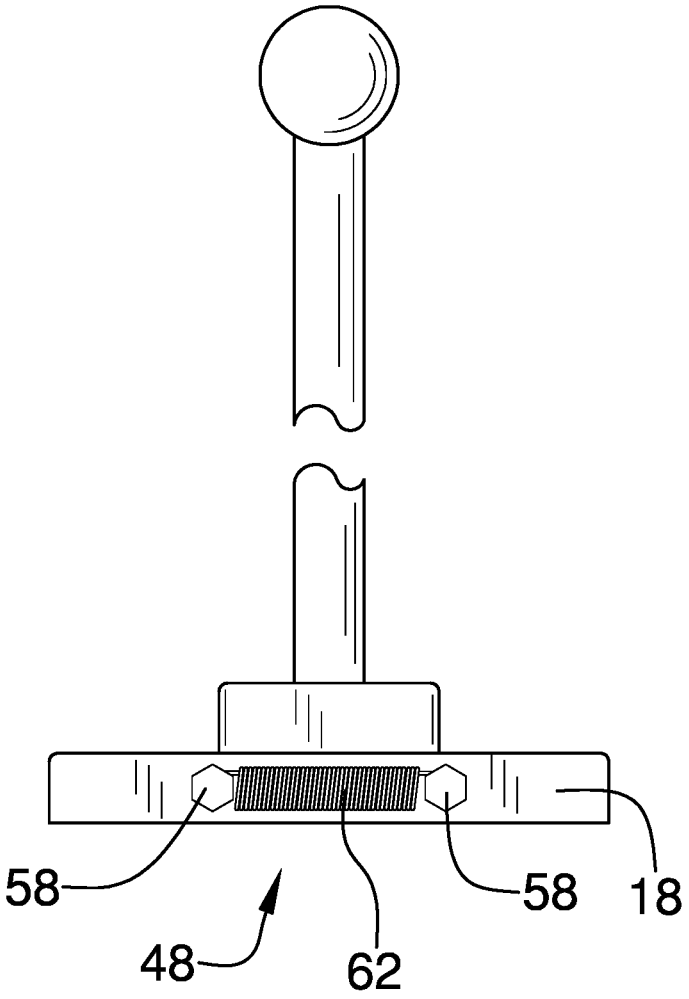
FIG. 3 is a front view of an embodiment of the disclosure.
Figure 4:
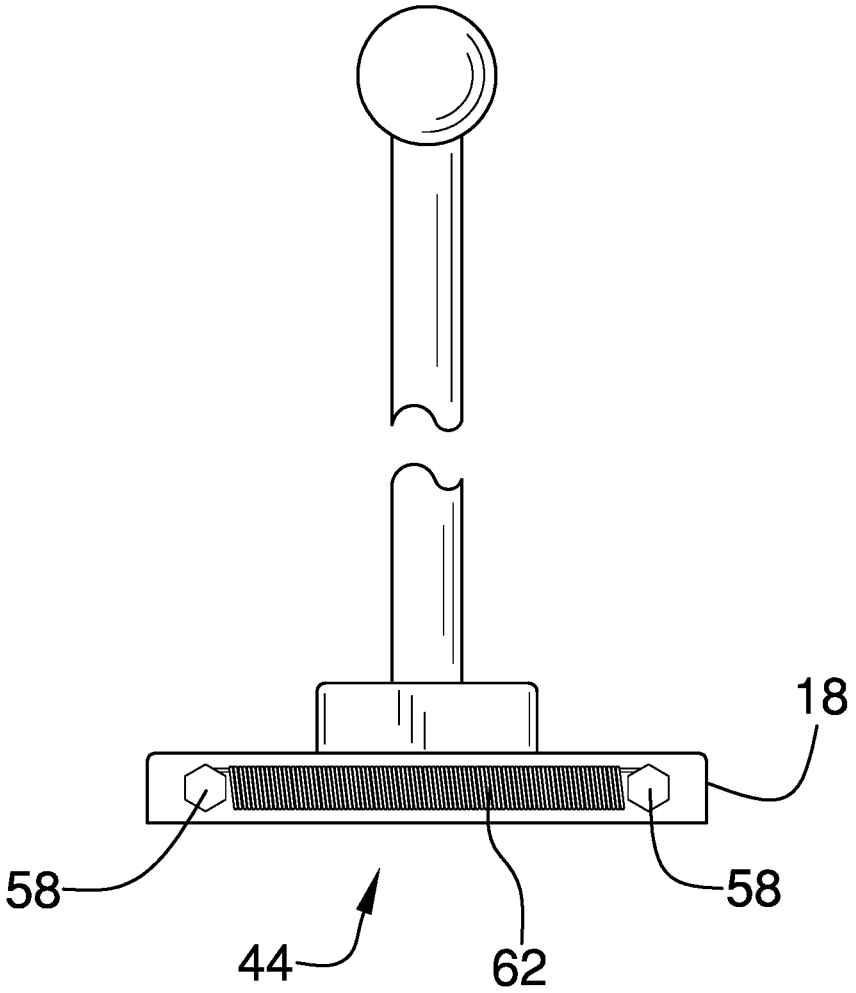
FIG. 4 is a rear view of an embodiment of the disclosure.
Figure 5:
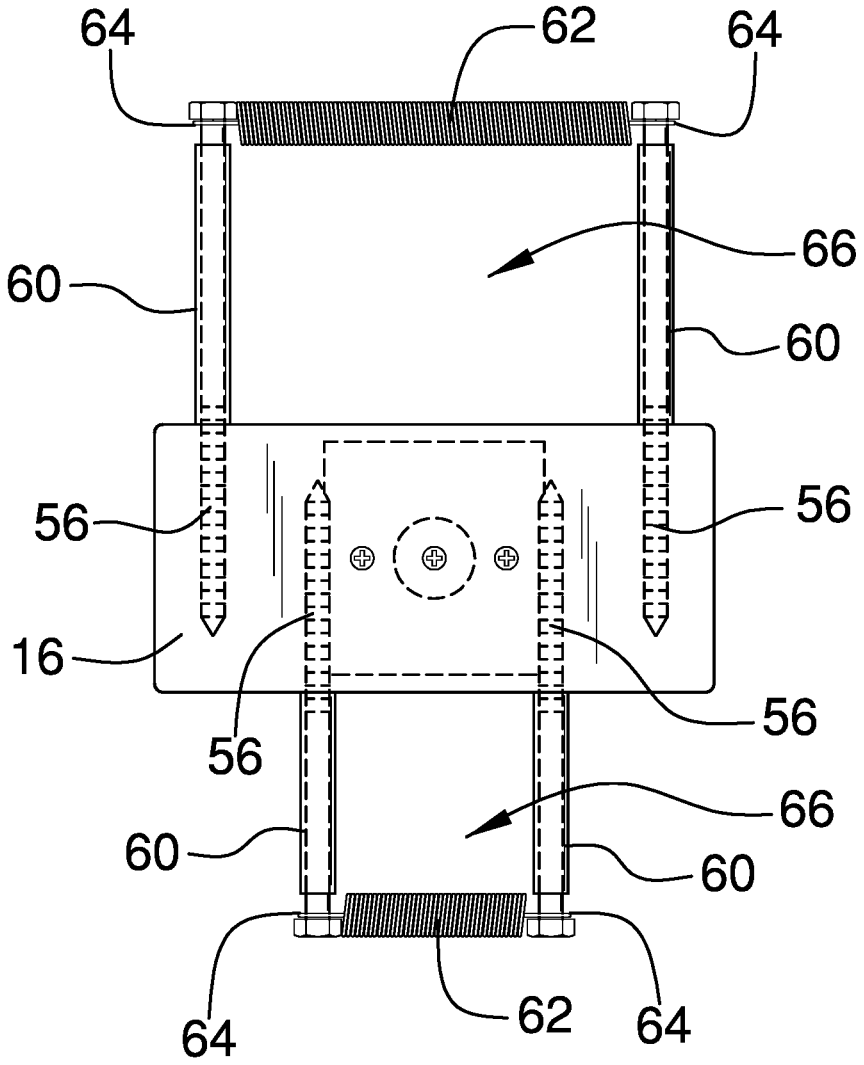
FIG. 5 is a bottom view of an embodiment of the disclosure.
Figure 6:
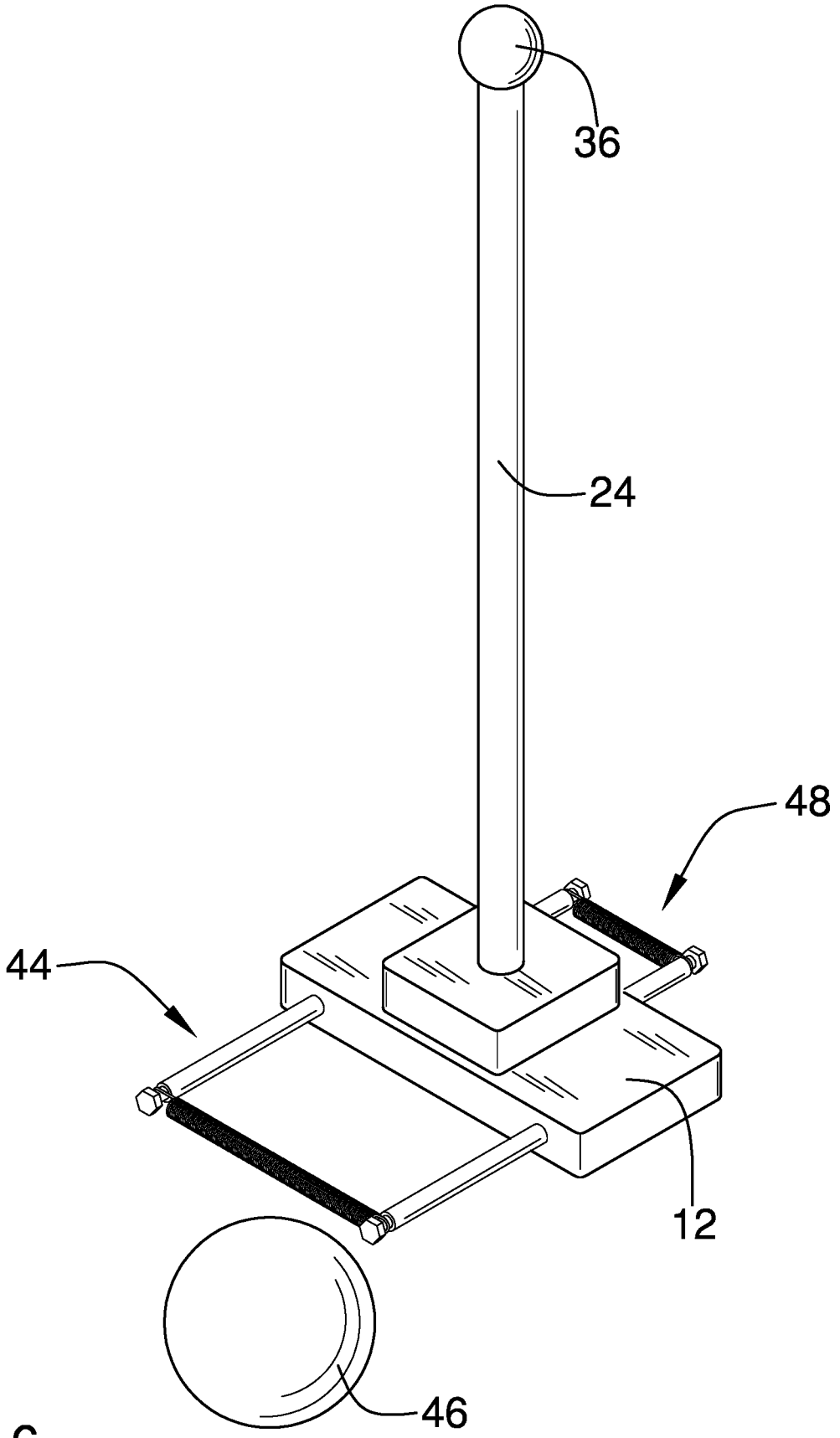
FIG. 6 is a exploded view of an embodiment of the disclosure.
Figure 7:
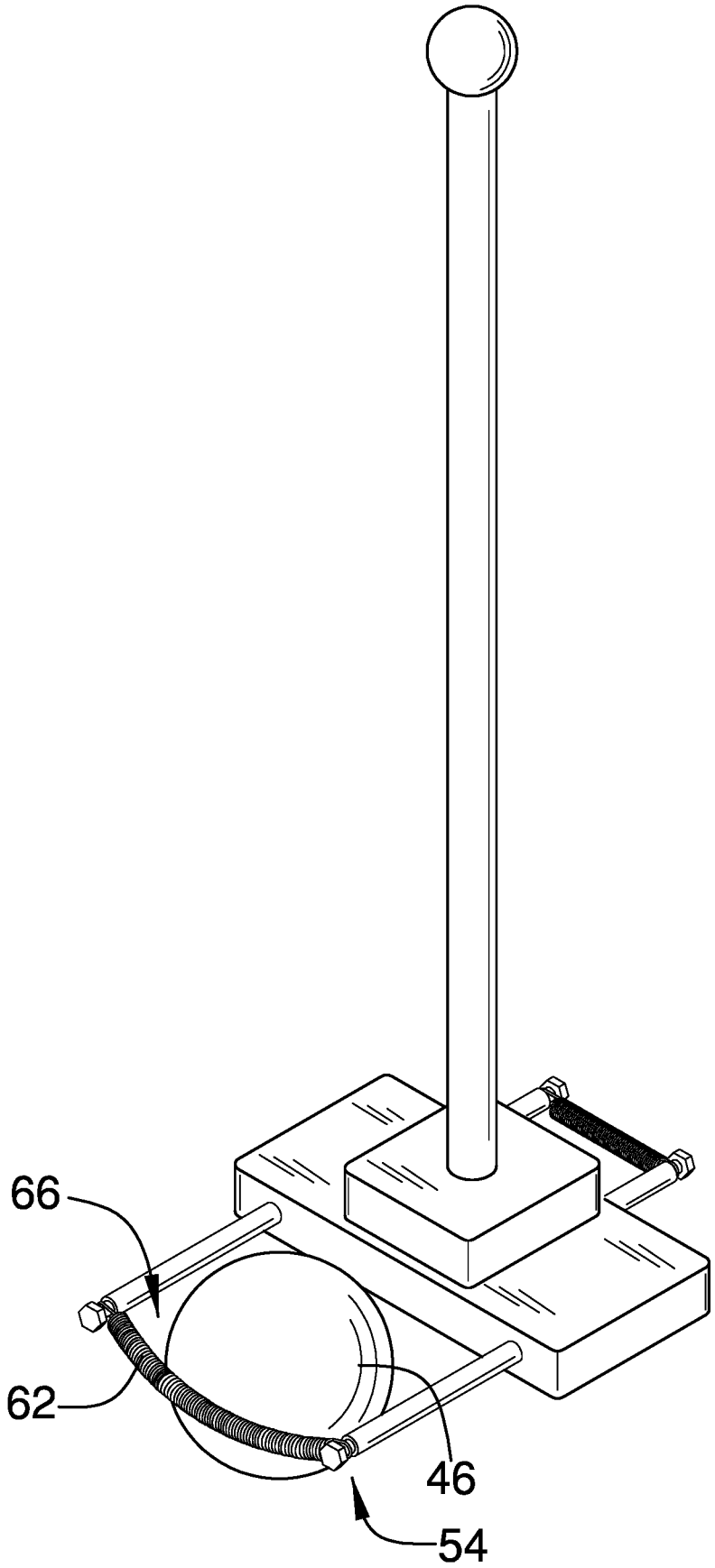
FIG. 7 is an in-use view of an embodiment of the disclosure.
Figure 8:
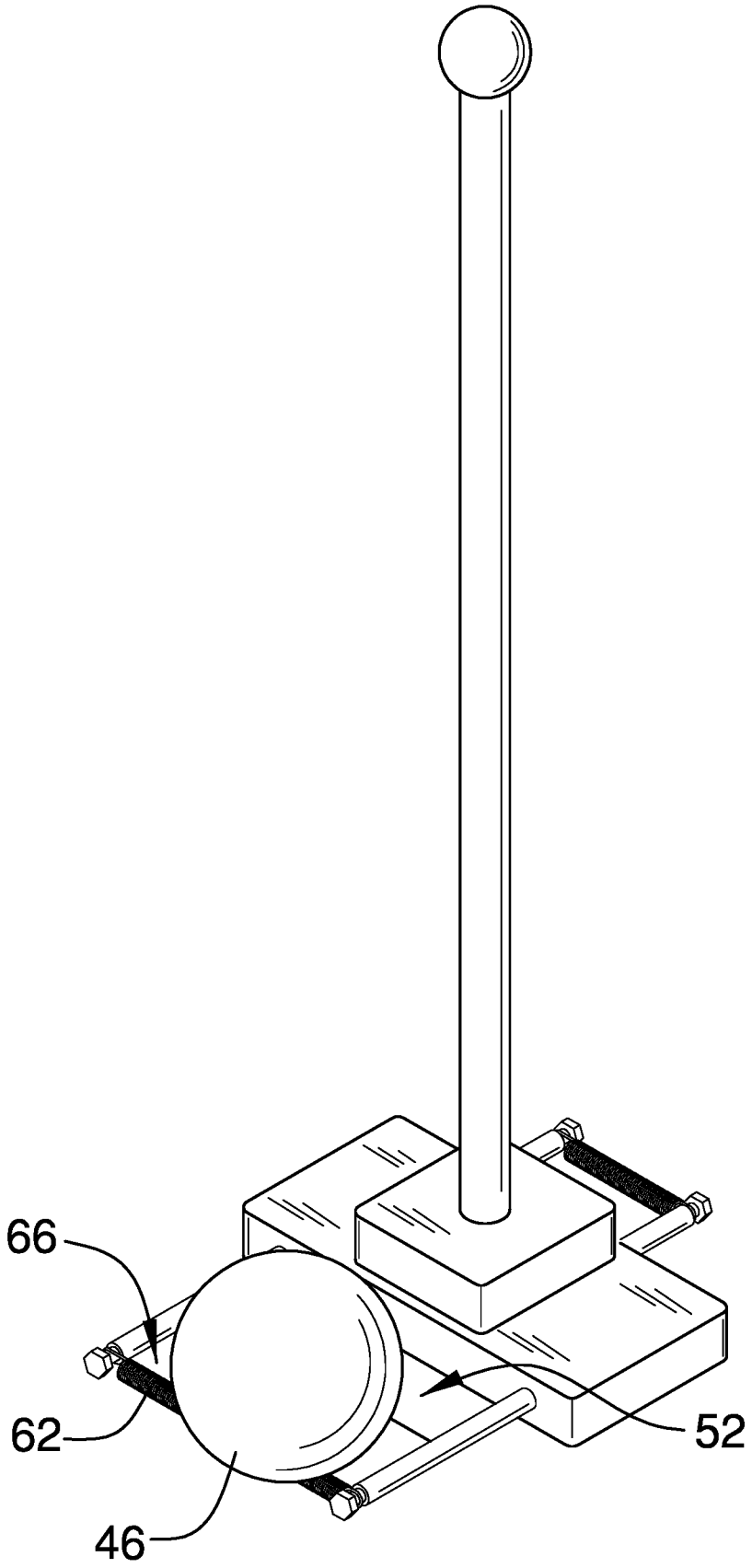
FIG. 8 is an in-use view of an embodiment of the disclosure.
Figure 9:
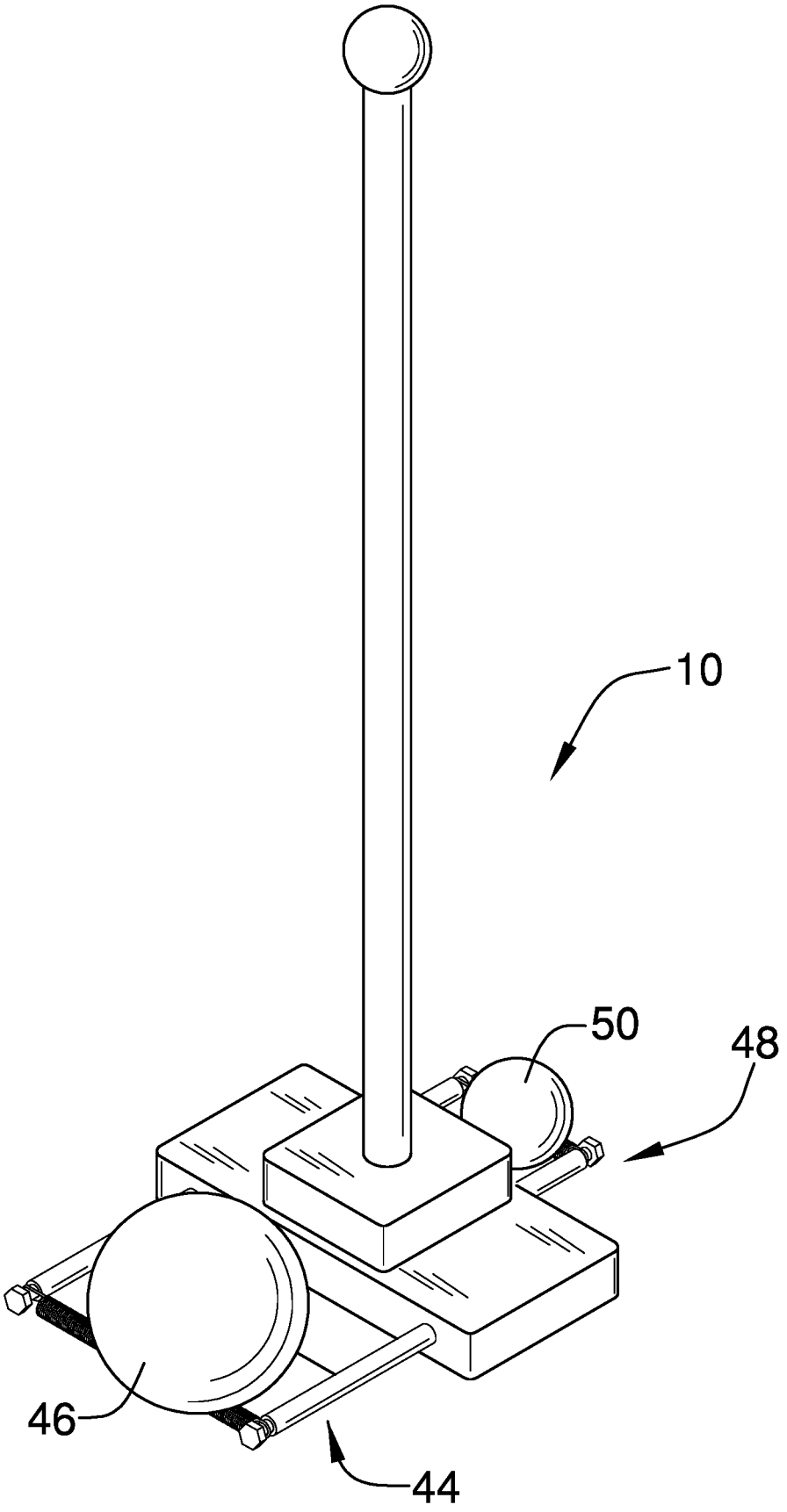
FIG. 9 is an in-use view of an embodiment of the disclosure.
Figure 10:
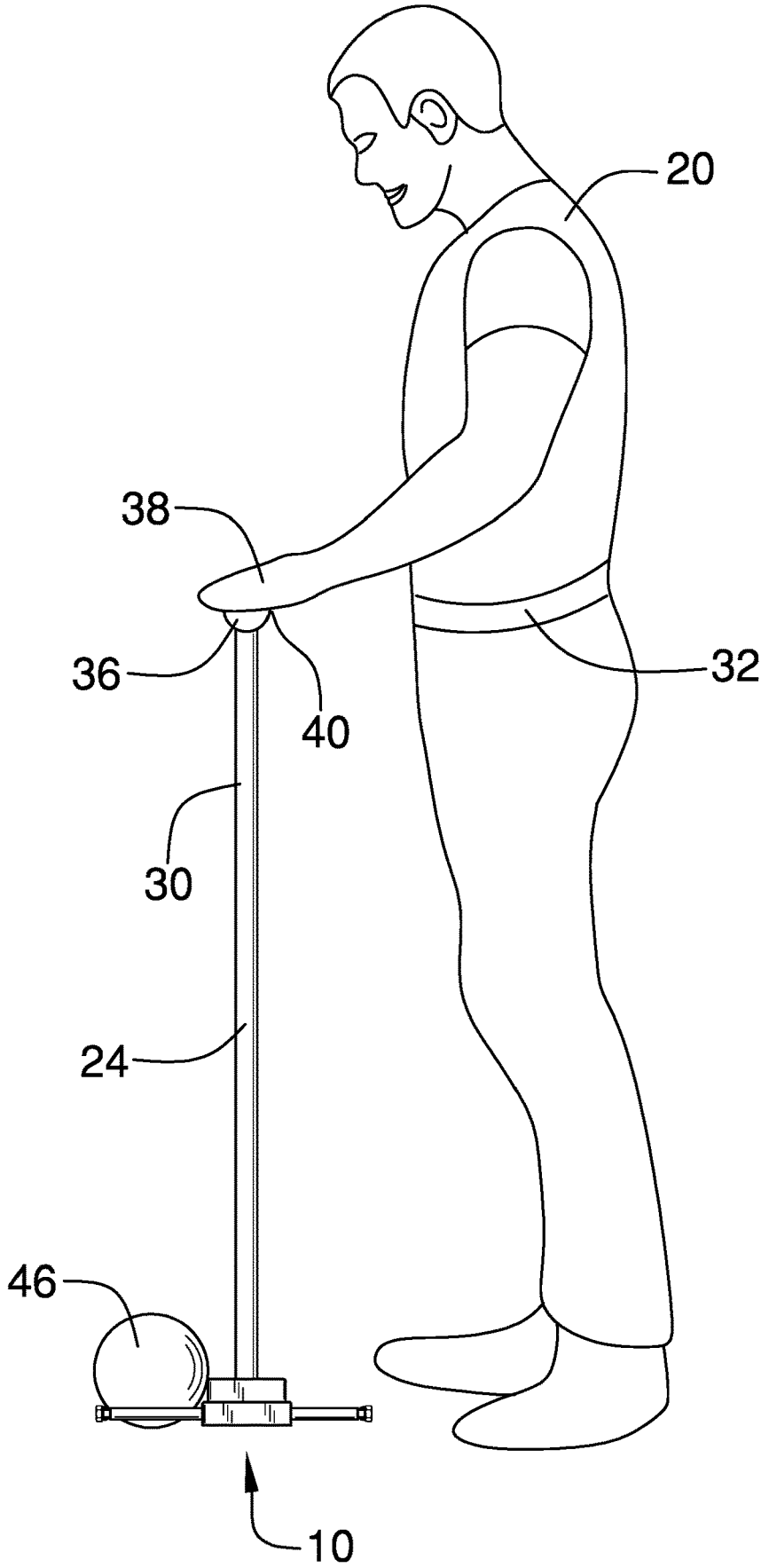
FIG. 10 is an in-use view of an embodiment of the disclosure.

With reference now to the drawings, and in particular to FIGS. 1 through 10 thereof, a new ball catching device embodying the principles and concepts of an embodiment of the disclosure and generally designated by the reference numeral 10 will be described.

As best illustrated in FIGS. 1 through 10, the extended ball retrieving device and method 10 generally comprises a base 12. The base 12 is a rectangular prism shape including has top surface 14, a bottom surface 16, and a pair of side surfaces 18. Each of the side surfaces 18 is positioned parallel relative to each other. Additionally, each of the side surfaces 18 is positioned perpendicular relative to the top surface 14 and the bottom surface 16. The top surface 14 of the base 12 is configured for being positioned facing upward towards a user 20 wherein the bottom surface 16 is configured for being positioned facing the ground 22. The pair of side surfaces 18 is interchangeable between facing the user 20 and facing away from the user 20.

A shaft 24 protrudes out from the top surface 14 of the base 12 and is configured for being a length 30 proximate to a waist 32 of the user 20. The shaft 24 is a cylindrical shape including a distal end 26 and a proximal end 28 relative to the base 12. The proximal end 28 of the shaft 24 is positioned in a center 34 of the top surface 14 of the base 12, whereas the distal end 26 of the shaft 24 has a handle 36 being configured for being positioned proximate to the user 20. The handle 36 is a spherical shape being configured for being grabbed by a hand 38 of the user 20 and being pushed on by the palm 40 of the user 20.

A pair of cradles 42 is positioned on a respective one of the pair of the side surfaces 18 of the base 12. A first cradle 44 of the pair of cradles 42 is configured for catching a bocce ball 46. A second cradle 48 of the pair of cradles 42 is smaller-scaled relative to the first cradle 44 and is configured for catching a pallino ball 50. Additionally, each of the cradles 42 has a top 52 and a bottom 54 wherein the bottom 54 is configured for facing the bottom surface 16 of the base 12 and the top 52 is configured for facing the top surface 14 of the base 12.

Each of the cradles 42 further comprises a pair of screws 56. The pair of screws 56 is drilled into the base 12 and is positioned perpendicular relative to the pair of side surfaces 18. Each of the screws 56 has an end 58 protruding out from the base 12 to provide enough room to position a ball through. The pair of screws 56 has a pair of covers 60 enwrapping a respective one of the pair of screws 56. Each of the covers 60 is a plastic material being configured for assisting in retaining the ball within each of the cradles 42 and providing a layer of protection from each of the screws 56 upon the ball.

A spring 62 is positioned at the end 58 of each of the screws 56. The spring 62 is configured for being bendable and expandable, such as a compression spring. In addition, the spring 62 is configured for being biased towards being unbent. The spring 62 is positioned parallel relative to the pair of side surfaces 18 of the base 12 and has a pair of loops 64 secured to a respective one of the end 58 of each of the screws 56. Furthermore, a trap 66 is enclosed between the spring 62 and the base 12. The trap 66 is a square shape and defines a space for the ball to be inserted through. The spring 62 of each of the cradles 42 is configured for bending around the ball when the trap 66 is being pushed down upon the ball.

In use, the user 20 grabs the handle 36 of the shaft 24 of the base 12 and positions the bottom 54 of the first cradle 44 of the pair of cradles 42 over the bocce ball 46. The user 20 pushes downward on the handle 36 using the palm 40 of the hand 38 of the user 20 wherein inserting the bocce ball 46 through the trap 66 of the first cradle 44. The spring 62 of the first cradle 44 bends around the bocce ball 46 prior and unbending after the bocce ball 46 has passed wherein catching the bocce ball 46 within the top 52 of the first cradle 44. The user 20 can use the second cradle 48 of the pair of cradles 42 to catch the pallino ball 50. The user 20 reduces the need to bend over to retriever the bocce ball 46 wherein ameliorating the game with the bocce ball 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An extended ball retrieving device configured for catching a bocce ball without the user bending over, the extended ball retrieving device comprising:

a base being a rectangular prism shape, the base having top surface and a bottom surface, the base having a pair of side surfaces;

a shaft protruding out from the top surface of the base, the shaft having a distal end and a proximal end relative to the base, the distal end of the shaft having a handle;

a pair of cradles being positioned on a respective one of the pair of the side surfaces of the base, each of the cradles further comprising:

a pair of screws being drilled into the base, each of the screws having an end, the end of each of the screws protruding out from the base; and a spring being positioned at the end of each of the screws, a trap being enclosed between the spring and the base, the trap defining a space for a ball to be inserted through.

2. The extended ball retrieving device of claim 1, further comprising each of the side surfaces being positioned parallel relative to each other.

3. The extended ball retrieving device of claim 2, further comprising each of the side surfaces being positioned perpendicular relative to the top surface and the bottom surface.

4. The extended ball retrieving device of claim 1, further comprising the shaft being a cylindrical shape.

5. The extended ball retrieving device of claim 4, further comprising the proximal end of the shaft being positioned in a center of the top surface of the base.

6. The extended ball retrieving device of claim 5, further comprising the handle being a spherical shape, the handle being configured for being grabbed by a hand of the user.

7. The extended ball retrieving device of claim 1, further comprising a first cradle of the pair of cradles being configured for catching a bocce ball.

8. The extended ball retrieving device of claim 7, further comprising a second cradle of the pair of cradles being smaller-scaled relative to the first cradle.

9. The extended ball retrieving device of claim 8, further comprising each of the cradles having a top and a bottom.

10. The extended ball retrieving device of claim 1, further comprising the pair of screws being positioned perpendicular relative to the pair of side surfaces.

11. The extended ball retrieving device of claim 10, further comprising the pair of screws having a pair of covers, the pair of covers enwrapping a respective one of the pair of screws.

12. The extended ball retrieving device of claim 1, further comprising the spring being configured for being bendable and expandable.

13. The extended ball retrieving device of claim 12, further comprising the spring being a compression spring, the compression spring being biased towards being unbent.

14. The extended ball retrieving device of claim 13, further comprising the spring being positioned parallel relative to the pair of side surfaces of the base.

15. The extended ball retrieving device of claim 14, further comprising the spring having a pair of loops, each of the loops of the spring being secured to a respective one of the end of each of the screws.

16. An extended ball retrieving device configured for catching a bocce ball without the user bending over, the extended ball retrieving device comprising:

a base being a rectangular prism shape, the base having top surface and a bottom surface, the base having a pair of side surfaces, each of the side surfaces being positioned parallel relative to each other, each of the side surfaces being positioned perpendicular relative to the top surface and the bottom surface;

a shaft protruding out from the top surface of the base, the shaft being a cylindrical shape, the shaft having a distal end and a proximal end relative to the base, the proximal end of the shaft being positioned in a center of the top surface of the base, the distal end of the shaft having a handle, the handle being a spherical shape, the handle being configured for being grabbed by a hand of the user;

a pair of cradles being positioned on a respective one of the pair of the side surfaces of the base, a first cradle of the pair of cradles being configured for catching a bocce ball, a second cradle of the pair of cradles being smaller-scaled relative to the first cradle, each of the cradles having a top and a bottom, each of the cradles further comprising:

a pair of screws being drilled into the base, the pair of screws being positioned perpendicular relative to the pair of side surfaces, each of the screws having an end, the end of each of the screws protruding out from the base, the pair of screws having a pair of covers, the pair of covers enwrapping a respective one of the pair of screws; and a spring being positioned at the end of each of the screws, the spring being configured for being bendable and expandable, the spring being a compression spring, the compression spring being biased towards being unbent, the spring being positioned parallel relative to the pair of side surfaces of the base, the spring having a pair of loops, each of the loops of the spring being secured to a respective one of the end of each of the screws, a trap being enclosed between the spring and the base, the trap defining a space for a ball to be inserted through.

* * * * *